United States Patent [19]

Rorer

[11] 3,977,156

[45] Aug. 31, 1976

[54] SEQUENTIAL CYCLING SKIN-PACKAGING APPARATUS

[76] Inventor: Donald R. Rorer, 408 W. Hawthorne, Lake Bluff, Ill. 60044

[22] Filed: June 26, 1975

[21] Appl. No.: 590,705

Related U.S. Application Data

[63] Continuation of Ser. No. 451,010, March 14, 1974, abandoned.

[52] U.S. Cl. ..... 53/112 A; 415/123

[51] Int. Cl.[2] ..... B65B 31/00

[58] Field of Search ..... 53/22 A, 112 A; 415/123; 188/296

[56] References Cited

UNITED STATES PATENTS

| | | | |
|---|---|---|---|
| 2,378,489 | 6/1945 | Loughridge | 415/123 X |
| 2,927,409 | 3/1960 | Heyer | 53/22 A |
| 3,071,905 | 1/1963 | Morse | 53/22 A |
| 3,387,426 | 6/1968 | Kraut et al. | 53/22 A |
| 3,587,200 | 6/1970 | Stone et al. | 53/112 A X |

*Primary Examiner*—Travis S. McGehee

*Attorney, Agent, or Firm*—Hill, Gross, Simpson, Van Santen, Steadman, Chiara & Simpson

[57] ABSTRACT

A sequential cycling high speed continuously operating skin packaging machine for encasing an article on a porous base pad or substrate in a thin film of thermoplastic material, in which the machine is provided with novel film and substrate drive mechanism providing accurate substrate indexing, novel film tucking during package evacuation, and improved film heating, all providing a simplified construction coupled with improved high speed performance.

8 Claims, 4 Drawing Figures

SEQUENTIAL CYCLING SKIN-PACKAGING APPARATUS

This is a continuation of application Ser. No. 451,010, filed Mar. 14, 1974 now abandoned.

BACKGROUND OF THE INVENTION

This invention relates generally to packaging machines designed to encase an article, or articles, upon a base pad or substrate in a protective film of theromplastic material by vacuum forming. Machines employing vacuum forming operations to produce such packages have been employed for many years and are generally referred to as "skin-packaging" machines. The product produced on such machines is quite typically structured for mounting on a hook or the like carried by a display board or rack. Such packages are quite typically termed "rack packages".

Typically, prior art apparatus for such skin-packaging has included a vacuum station upon which the substrate is positioned, a thermoplastic film dispensing system arranged to position film over the substrate on the vacuum station, some form of heating element for preheating the thermoplastic film, and a vacuum source for applying vacuum to the substrate to pull the heated film tightly against the substrate around a product resting thereon. Substantially all prior art skin packaging apparatus has provided the functions above set forth. However, the difficulties inherent in properly heating a thin film or thermoplastic material at the appropriate time for forming it about a properly positioned product on a substrate and sequentially performing such operations at a maximum cycle rate has not readily been accomplished and to my knowledge no prior art apparatus has successfully accomplished continuous skin packaging with simple, and relatively inexpensive, apparatus. Apparatus of the type previously known includes, for example, those of my prior U.S Pat. Nos. 3,377,770; 3,534,521; 3,550,348; and 3,587,200, as well as those of others, such as, for example, U.S. Pat. No. 3,204,384 of Donald E. Dallas; U.S. Pat. No. 3,071,905 to Hugh B. Morse, and U.S. Pat. No. 3,676,979 to Thomas L. Schuette.

The prior art patents above mentioned succeed to various degrees in providing continuous packaging operation. They have not, however, provided the extremely simple and almost foolproof operation of the present apparatus nor have they been able to provide the accuracy of sequencing control available in accordance with the present invention.

SUMMARY OF THE INVENTION

The apparatus of the present invention incorporates a novel sequential drive mechanism appropriately coupled to film transport and heating mechanism in a manner providing simple, rapidly-acting, in-line, skin-packaging. The system incorporates simple means for abruptly stopping the package, or substrate drive mechanism at a predetermined, substantially exact, position, and a simple mechanical means for tucking the thin thermoplastic film against the substrate adjacent its trailing edge simultaneously with the application of vacuum to the substrate. Means is provided for heating the thin film immediately prior to its positioning over the substrate upon the vacuum station platen. In accordance with the present invention, drive medhanism for moving the substrate elements toward and onto the vacuum platen and for moving the thin thermoplastic film past the heaters and into position above the vacuum platen comprises a fluid pressure motor. The fluid pressure motor is operable by pressurized air available from any conventional source of air under pressure. The pneumatic drive is controlled in a novel manner in accordance with the present invention by means of a solenoid operated valve or the like positioned at the exhaust of the fluid motor. Operation of the motor valve is automatically controlled by means sensing the position of an appropriate substrate, and upon actuation of the valve to stop the substrate drive, a vacuum control valve is opened and simultaneously a reciprocal film tucker is energized. Simultaneously with the application of vacuum and film tucker, a downstream cutting die section may be energized for severing adjacent skin packaged members.

In accordance with the improved apparatus of the present invention, there are only two separate parts of each operational packaging cycle. The first part is the drive for effecting substrate and film movement, in which the drive motor valve is open and the drive operates, feeding film and substrate simultaneously. The film heater is energized during this part, as well as the second part of the cycle. The second part is indexed drive stoppage, operation of the film tucker, application of vacuum and operation, if appropriate, of the die cutter, all accomplished when, and only when, the drive motor valve is closed. By providing this simplified two-step cycle, I have provided an improved apparatus capable of extremely rapid packaging operation with an absolute minimum of maintenance down-time or constant close attention.

DETAILED DESCRIPTION

Figure 1:
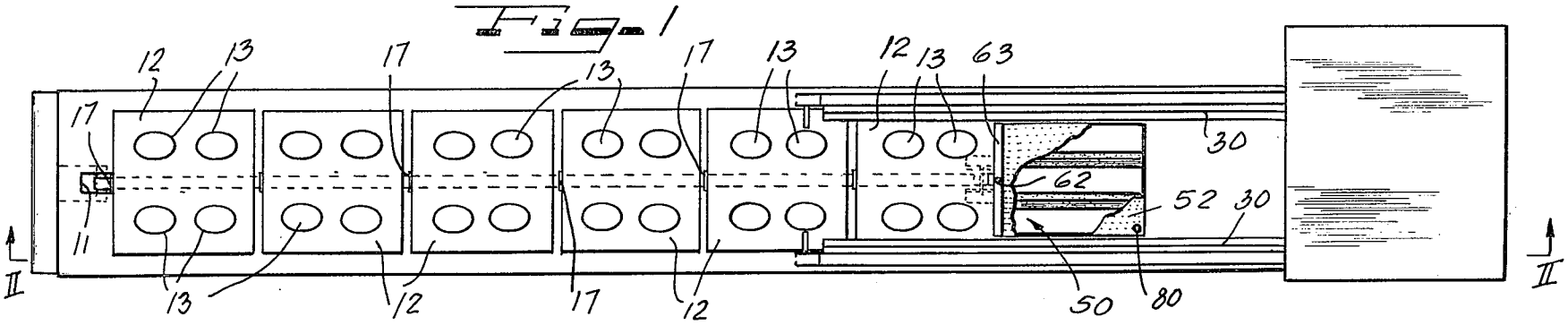
FIG. 1 is a plan view of the skin packaging apparatus of the present invention.
Figure 4:
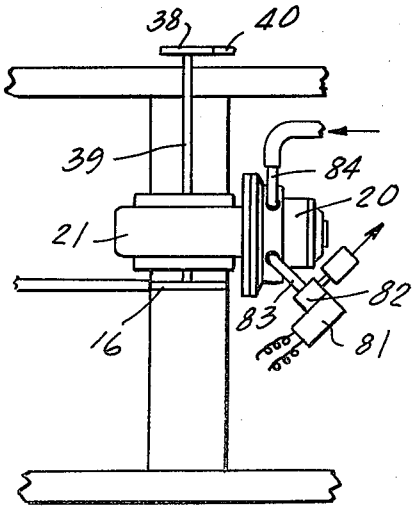
FIG. 4 is a view in partial cross-section taken along the line IV—IV of FIG. 2.
Figure 2:
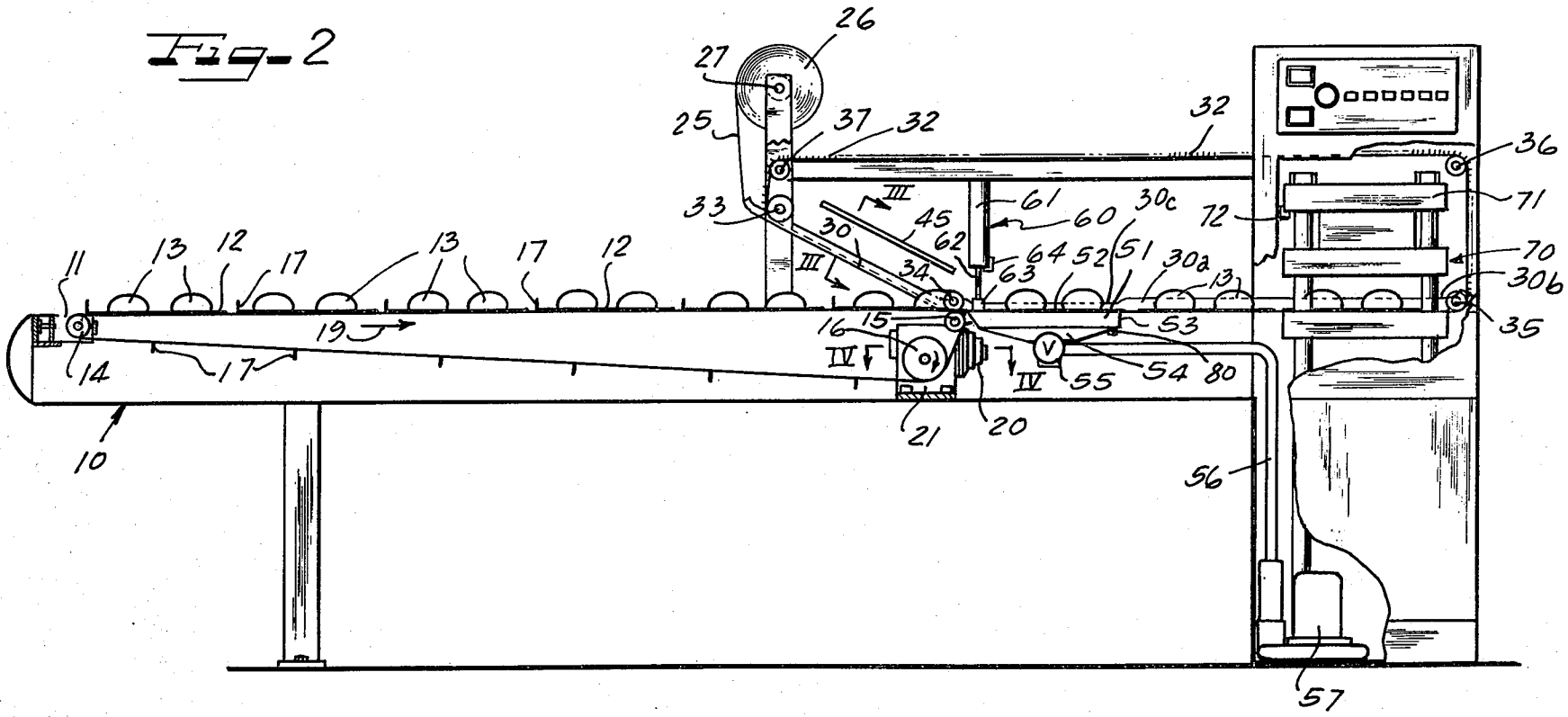
FIG. 2 is a cross-sectional, side-elevational view taken along the line II—II of FIG. 1.

Referring to the drawings, and particularly FIGS. 1 and 2, the sequential cycling skin-packaging machine of the present invention comprises a frame generally indicated at 10 providing support for the several subassemblies of the skin packaging apparatus. A horizontal table 11 is provided for the support of a plurality of package substrates 12 carrying a product 13 intended to be skin-packaged by the application of a thermoplastic film from above. A roller link sprocket chain 18 passing around sprockets 14, 15 and 16 is provided with lugs 17 removably attached thereto by any conventional means. The lugs 17 provide a back-stop and drive mechanism for sliding the substrates 12 along the horizontal table 11 in the direction of the arrow 19.

The sprocket chain 18 is driven, in accordance with the present invention, by sprocket 16 which is, in turn, rotated by a pneumatic motor 20 via a reduction gear transmission 21. As can be seen from a consideration of FIG. 2, the chain 13 provides a delivery system permitting the manual application of substrates 12 onto the table 11 by one or more persons in a manner providing a uniform sequence of substrates. At the same time, it will be apparent that if through inadvertence as occasionally happens in assembly line procedures, a subate is not positioned on the conveyor in its intended ace, so that a blank space in the sequence is caused, change in the substrate spacing occurs. In these cumstances, an inadvertently omitted substrate in no y modifies the precise spacing of the over-all system. As the substrates 12 move horizontally along the le 11 in the direction of the arrow 19, they are seentially contacted by a plastic film 25. Film 25 is fed m supply roll 26 rotatably mounted on supports 27 id with the frame 10. The film 25 is, as can be seen m the consideration of FIG. 3, carried along guideys 30 on opposite sides of the apparatus, by means of oller chain 31. The chain 31 is of the roller, sprocket e and is provided at each pivot thereof, or at spaced ots, if desired, with tines 32 which, at sprocket 33 gage the film 25 sliding downwardly along guideways . On engagement with the film 25, the tines 32 pierce film and positively draw it downwardly toward the ht as shown in FIG. 2 in the guides 30, and along the rizontal table toward the right as viewed in FIG. 2. e horizontal movement is occasioned by bending the ides 30 into the horizontal configuration as at 30*a*. e horizontal extensions 30a of the guides 30 extend ward the right as viewed in FIG. 2, terminating at a int 30*b* slightly in advance of sprocket 35 over which sprocket chain passes to sprockets 36 and 37 for urn to the guide 30. Preferably, the chain 31 is ven by sprocket 34 which is synchronous with rocket 15 but rotatable in the opposite direction of ation. It may be driven from sprocket 38, shown in G. 4 which is driven by reduction gear 21 in a direcn counter-rotative to the sprocket 16 via counterative shaft 39. Conventional sprocket chain 40 may employed to drive the sprocket 34 in this arrangent. As above noted, it is prefereed that the film 25 vel at identically the same speed as the substrates 12 d in accordance with the present invention, the subates 12 are picked up and moved along by the film when the force applied to the substrates 12 by the ain 18 terminates.

Figure 3:
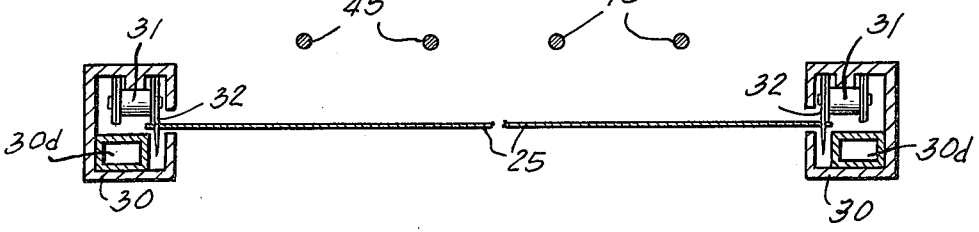
FIG. 3 is a cross-sectional view taken along the line III—III of FIG. 2 showing details of the film feed.

As the film 25 passes through the guides 30, as shown FIG. 3, it is heated by radiant heaters 45. The heaters are designed to provide sufficient heat to cause the n 25 to drape downwardly to softly envelope the oduct 13 on the substrate 12 in the area immediately or to the location of the sprockets 15 and 34. With thus draped substrate moving to the right, it is posined over the vacuum station generally indicated at which includes a platen 51 comprising a perforated face 52 forming an extension of the table top 11 and ported by integral sheet metal edge 53. The platen is preferably loosely insertable from above and rests on a vacuum chamber 54 supplied by valve 55 from acuum line 56 evacuated by a centrifugal vacuum mp 57 of high capacity sufficient to cyclically evacu- the platen 51 during each cycle of operation with- t the need for a vacuum storage tank. Upon evacuan of the platen 51 with the substrate 12 thereabove d the film 25 draped thereover, the film is sucked wnwardly into tight configuration with the product and the substrate 12 to form a skin package. During eration of the apparatus in its sequential cycling de, the heaters are energized during both parts of cycle so that as one package is being evacuated, the n for the next is being softened.

A substantial disadvantage of prior systems has been adequate sealing of the film around the perimeter of substrate during the evacuation process. In prior art systems no means has been provided for sealing the trailing edge or side edges of the film 25 to the substrate and, accordingly, substantial vacuum loss or by-pass occurred. Such losses required large vacuum sources and, accordingly, in conventional prior art systems, vacuum storage tanks were required to provide satisfactory operation. However, in accordance with the present invention, the trailing edge of the film 25 is tucked downwardly against the substrate by a film tucker generally indicated at 60 and comprising a cylinder 61 with a reciprocal rod 62 carrying a horizontal tucking bar 63. In the cyclical operation of the machine, the tucker bar 63 is reciprocated downwardly providing a horizontal rear seal between the film 25 and the substrate 12. The side edges of the film 25 are positively held downwardly at the sides of the platen by the chains 31 and tines 32, carried along by horizontal guide portions 30a which are preferably depressed slightly, as at 30c along and adjacent the sides of the platen 51. The forward edge of the film is in positive contact with the leading edge of the substrate 12 as a result of its initial contact therewith at the general location of the sprockets 15, 34. As a result, total peripheral sealing is provided, and relatively little air must be evacuated from the package. Accordingly, the requirements of the vacuum pump 57 have been substantially reduced permitting elimination of vacuum storage chambers, or the like.

The driving, or first part of the cyle of operations occurs as above described. An electric eye sensor 80 is provided for controlling the two-stage operation of the apparatus. In my preferred embodiment the eye incorporates a vertically projecting light beam sensed by a photoelectric pick-up or sensor 80 below the bed of the table. Resurgence of the light beam following interruption by a substrate places the circuit in reset condition and subsequent interruption of the light by an approaching substrate opens a switch to deenergize solenoid 81 when a substrate is positioned over the vacuum platen. When no substrate is over the platen due, perhaps, to failing to insert a substrate on the table in the usual order, the drive operates until one does appear. Accordingly, the film is never sucked down on the platen in the absence of a substrate.

The second step of the process occurs upon stoppage of the motor 20 by deenergization of the solenoid 81 to close the valve 82 in motor outlet 83. Simultaneously with this deenergization of solenoid 81, the film tucker 60 is energized and valve 55 is opened to chamber 54. In this operation, the tucker 60 may be provided with a pneumatic cylinder 61 operated by air under pressure. However, it will be apparent that an electrical solenoid may be employed, if preferred. In either case, it is preferred that the piston 62 be spring-biased in the upper direction so that upon release of the energy source, either pneumatic or electric, the piston 62 will move to its upward position closing limit switch 64. When a die cutter 70 is employed, its ram 71 is energized downwardly to die cut the filmed substrate during this step of the cycle.

Upon passage of a predetermined short timer-controlled interval, found sufficient to provide snug confrontation of the film 25 about the product 13 and intimate adhesive contact with the substrate 12, valve 55 is energized to its second position connecting the chamber 54 to atmosphere in a conventional manner. The film tucker 60 is deenergized, and the hydraulic ram of the die-cutter is reciprocated upwardly. No further operation of the cycle can occur until limit switch 64 actuated by the upward movement of the tucker bar 63 and the limit switch 72 activated by upward movement of the die-cutter ram 71 are closed. When these switches are closed, the drive of motor 20 is started by energization of solenoid 81 to open valve 82, whereupon the drive cycle again proceeds automatically under the control of the electric eye 80.

Operation of the cycle may be essentially continuous and may be varied over a wide range of times. I have found apparatus of the present invention, as above described, capable of 12 cycles per minute on a continuing basis. This time may be substantially slowed however without in any way adversely effecting the system, upon lowering the temperature of the heaters 45 by any conventional thermostat control means. I have found that the system of the present invention is operable with extremely thin thermoplastic films such as polyethylene, polyvinylchloride, Surlyn, or the like, as well as heavier ones in the 20 mil. range.

In view of the relatively small number of controls required for this apparatus, it may readily be operated semi-automatically or manually. In such operation, the individual elements may be operated as desired, with the exception that the limit switches sensing the upper position of the film tucker and hydraulic die-cutter must be in the circuit controlling the drive motor 20 at all times, to prevent attempted forward motion of the packaging line with those elements in the down, interference, position.

Of course, various motors, valves and switches may be used in this inventive structure. I have found continuously running vacuum pumps such as manufactured by Siemens Model 2CH6, or Gast/Becker Model SV380-1 provide satisfactory vacuum source and simultaneously adequate high pressure air to drive motor 20 and tucker 60. I have likewise successfully employed as motor 20, a rotary vane type Motor Model 4 AM manufactured by Gast and as reduction gear 21*a* Model 133T manufactured by Winsmith.

It will be apparent to those skilled in the art that modifications may be made to the apparatus above described without departing from the scope of the novel concepts of my invention. It will be apparent, for example, that the removable platen 51 may have perforations throughout its entire upper surface, or, if smaller packages are desired to be made on smaller substrates, the area of perforations may be made smaller merely by substituting platens. Similarly, while the present apparatus provides an extremely efficient continuous packaging and cutting system, the die cutter may, if desired for manufacturing reasons, be omitted or moved a substantial distance away. In these latter circumstances, a single cut-off blade conventional construction may be incorporated downstream of the vacuum station. Since, however, the cyclic system above described provides die-cutting of the substrate in perfectly timed relation thereby requiring no additional time for the complete operation once the system is on-stream, it is preferred that the cutting stage be incorporated. I have found the described apparatus able to operate successfully on a continuous basis with a minimum of attention. In such conditions it may be desirable to provide cooling at varioius points in the system. For example, the guides 30 may be hollow to provide water coolant, as at 30*d*, throughout the portion adjacent heaters 45. Other variations may, of course, be made and it is, accordingly, my intent that the scope of the invention be limited solely by that of the hereinafter appended claims.

I claim as my invention:

1. A vacuum packaging apparatus comprising a generally horizontal conveyor for transporting sequentially step-by-step a plurality of porous product-supporting packaging substrates, a continuous strip thermoplastic film supply, a vacuum source, a fixed perforate vacuum packaging element support platen, means positively releasably connected to both sides of the film strip directing said film progressively step-by-step toward and longitudinally of the conveyor to a position thereover in face-to-face contact with said substrate positioned on said platen and held downwardly against the sides thereof, motor means for cyclically moving said conveyor, sensing means for sensing the positioning of a substrate on said platen, control means stopping said motor when said sensing means indicates a substrate is in position on said platen, and tucker means downwardly actuatable against said film to tuck said film against said substrate adjacent its trailing edge simultaneously with the connection of said vacuum source to said platen.

2. The structure set forth in claim 1 wherein said motor means comprises a rotary pneumatic motor having an air inlet and outlet and wherein said control means includes a valve in said outlet operable to close said outlet to stop said motor.

3. The structure of claim 1 wherein a die cutter is positioned downstream of said platen a distance equal to a multiple of the cyclic movement of said conveyor and means operated simultaneously with said tucker means to actuate said die cutter to trim said substrate.

4. The structure of claim 1 wherein a switch means responsive to the retracted position of said tucker means permits energization of said valve only when said tucker is retracted.

5. The structure of claim 3 wherein first switch means responsive to the retracted postion of said tucker means and second switch means responsive to the retracted position of said die cutter permit energization of said valve to operate said motor only when said tucker and die cutter are retracted.

6. The structure of claim 1 wherein said means directing said film comprises parallel guides and positive gripping means associated with and traveling parallel to said guides for holding said film downwardly upon said substrate on said platen.

7. The structure of claim 1 wherein said conveyor and said film directing means travel simultaneously and at the same speed and wherein said conveyor terminates adjacent said platen, whereby said film directing means acts to carry said substrate to positions beyond said platen for cyclic die cutting in precise timed position during subsequent cycles.

8. A motor drive indexing means for conveyors, or the like, comprising a rotary continuously operable, selectively stoppable fluid motor actuated by fluid under positive pressure for driving said indexed means, fluid inlet means directing fluid under pressure to said motor, fluid outlet means comprising the sole outlet for exhaust fluid from said motor, valve means in said outlet means for stopping said motor by completely stopping flow through said outlet in response to an indexing signal, and means applying an indexing signal to said valve means.

* * * * *